US011328640B1

(12) United States Patent
Zhou

(10) Patent No.: US 11,328,640 B1
(45) Date of Patent: May 10, 2022

(54) GOA DRIVING CIRCUIT, DISPLAY PANEL AND DISPLAY DEVICE

(71) Applicant: WUHAN CHINA STAR OPTOELECTRONICS TECHNOLOGY CO., LTD., Wuhan (CN)

(72) Inventor: Yongxiang Zhou, Wuhan (CN)

( * ) Notice: Subject to any disclaimer, the term of this patent is extended or adjusted under 35 U.S.C. 154(b) by 205 days.

(21) Appl. No.: 16/772,782

(22) PCT Filed: Mar. 24, 2020

(86) PCT No.: PCT/CN2020/080975
§ 371 (c)(1),
(2) Date: Jun. 14, 2020

(87) PCT Pub. No.: WO2021/174607
PCT Pub. Date: Sep. 10, 2021

(30) Foreign Application Priority Data

Mar. 3, 2020 (CN) ..... 202010138414.6

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2310/08* (2013.01)

(58) Field of Classification Search
CPC ..... G09G 3/20; G09G 2300/0408; G09G 2310/0267; G09G 2310/08
See application file for complete search history.

(56) References Cited

U.S. PATENT DOCUMENTS

2001/0055152 A1* 12/2001 Richards ..... G02B 27/0172 359/476
2016/0247322 A1* 8/2016 Komaki ..... G06F 3/013
2017/0270886 A1 9/2017 Yu

FOREIGN PATENT DOCUMENTS

| | | | |
|---|---|---|---|
| CN | 105788548 | A | 7/2016 |
| CN | 106098011 | A | 11/2016 |
| CN | 106782389 | A | 5/2017 |
| CN | 106991955 | A | 7/2017 |
| CN | 107731195 | A | 2/2018 |
| CN | 107749281 | A | 3/2018 |
| CN | 107767834 | A | 3/2018 |
| CN | 108010495 | A | 5/2018 |
| CN | 109036304 | A | 12/2018 |

* cited by examiner

*Primary Examiner* — Sejoon Ahn

(57) ABSTRACT

A GOA circuit, a display panel and a display device are provided. The GOA circuit includes a plurality of GOA units connected in series. The GOA unit includes a forward scan control module, a node signal control module, an output control module, a regulating module, a first pull-down module, a second pull-down module, a third pull-down module, a fourth pull-down module, and a switch module. The display device according to an embodiment only needs two clock signals for the GOA driving circuit to scan each row of gates. Furthermore, it could enormously reduce the width of GOA and realize the narrow side frame design.

10 Claims, 4 Drawing Sheets

GOA DRIVING CIRCUIT, DISPLAY PANEL AND DISPLAY DEVICE

FIELD OF THE INVENTION

The present invention relates to the display driving technique, and more particularly, to a GOA driving circuit, a display panel and a display device.

BACKGROUND OF THE INVENTION

As the development of the technology, electronic devices, such as cell phones, computers, and TVs, are widely used in our daily life. Therefore, the LCD panel and OLED display panel are widely adopted. The GOA (gate driver on array) circuit is an important component of the display panel. It manufactures the TFTs on the array substrate as switches and manufactures the gate driver on the array substrate for sequentially scanning the gates.

Based on the type of the TFTs in the display panel, it can be categorized as NMOS type, PMOS type or CMOS type. Accordingly, the GOA circuit could be a NMOS circuit, PMOS circuit or CMOS circuit. In contrast to CMOS circuit, NMOS circuit does not need the P doping process. This improves the yield and reduces the cost. Therefore, it is important for this industry to develop a stable NMOS circuit.

Full-screen has become a trend. This increases the demands of narrower side frames for cell phones, laptops, and TVs. In order to achieve this, shrinking the size of the GOA circuit is a common technique to do so.

However, the conventional GOA circuit is complicated and thus has larger size and thus its width is hard to shrink.

SUMMARY OF THE INVENTION

One objective of an embodiment of the present invention is to provide a GOA driving circuit, a display panel, and a display device to solve the above issue.

According to an embodiment of the present invention, a gate driver on array (GOA) circuit is disclosed. The GOA circuit comprises a plurality of GOA units connected in series. The GOA unit comprises: a forward scan control module, configured to control the GOA driving circuit to perform a forward scan according to a constant voltage level signal; a node signal control module, configured to control the GOA circuit to output a gate driving signal having a low voltage level in a non-working phase; an output control module, configured to control a gate driving signal of a current stage according to a clock signal of the current stage; a regulating module, configured to maintain a voltage level of a first node; a first pull-down module, configured to pull-down the voltage level of the first node; a second pull-down module, configured to pull-down a voltage level of a second node; a third pull-down module, configured to pull-down a voltage level of the gate driving signal of the GOA unit of the current stage; a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

According to an embodiment of the present invention, a display panel is disclosed. The display panel comprises a gate driver on array (GOA) circuit. The GOA circuit comprises a plurality of GOA units connected in series. The GOA unit comprises: a forward scan control module, configured to control the GOA driving circuit to perform a forward scan according to a constant voltage level signal; a node signal control module, configured to control the GOA circuit to output a gate driving signal having a low voltage level in a non-working phase; an output control module, configured to control a gate driving signal of a current stage according to a clock signal of the current stage; a regulating module, configured to maintain a voltage level of a first node; a first pull-down module, configured to pull-down the voltage level of the first node; a second pull-down module, configured to pull-down a voltage level of a second node; a third pull-down module, configured to pull-down a voltage level of the gate driving signal of the GOA unit of the current stage; a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

According to an embodiment of the present invention, a display device is disclosed. The display device comprises a display panel having a gate driver on array (GOA) circuit. The GOA circuit comprises a plurality of GOA units connected in series. The GOA unit comprises: a forward scan control module, configured to control the GOA driving circuit to perform a forward scan according to a constant voltage level signal; a node signal control module, configured to control the GOA circuit to output a gate driving signal having a low voltage level in a non-working phase; an output control module, configured to control a gate driving signal of a current stage according to a clock signal of the current stage; a regulating module, configured to maintain a voltage level of a first node; a first pull-down module, configured to pull-down the voltage level of the first node; a second pull-down module, configured to pull-down a voltage level of a second node; a third pull-down module, configured to pull-down a voltage level of the gate driving signal of the GOA unit of the current stage; a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

In an embodiment of the present invention, it does not require to add the number of the backward scan control module, the pull-up module and recovery module. In addition, it only requires two clock signals to complete the stage-by-stage driving tasks. In addition, it also simplifies the GOA driving circuit and further reduces the width of the GOA. Thus, the narrow side frame demands could be met. Here, the first clock signal is used to pull-up the voltage level of the first node. The second clock signal is used to pull-up the voltage level of the second node. Through increasing the number of the switch module, the first node and the second node could be charged in different time periods without completing with each other. Furthermore, less number of TFTs is used and only two clock signals are used, the number of signal lines are reduced and thus the width of the GOA is reduced. In this way, the narrow side frame design could be achieved. This reduces the risk in manufacturing process and raises the efficiency and stability.

BRIEF DESCRIPTION OF THE DRAWINGS

Embodiments of the present application are illustrated in detail in the accompanying drawings.

DETAILED DESCRIPTION OF PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

The embodiments described below with reference to the accompanying drawings are exemplary and are intended to be illustrative of the present application, and are not to be construed as limiting the scope of the present application.

Figure 1:
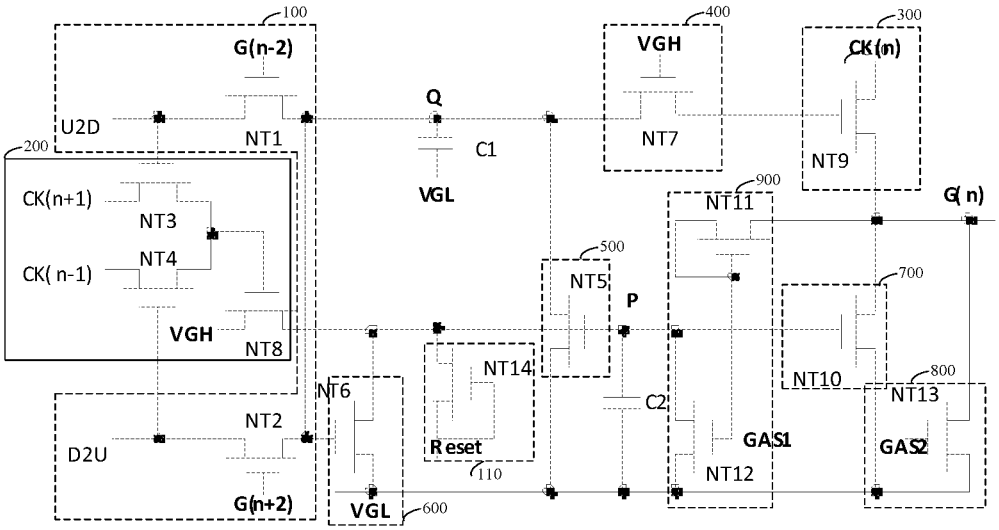
FIG. 1 is a diagram of a conventional GOA circuit.

Please refer to FIG. 1. A conventional GOA circuit is a 14T2C structure, including 14 TFTs (NT1-NT14) and 2 capacitors (C1 and C2). Here, the TFTs NT1-NT10, two capacitors and their connections constitute basic circuit structure. The TFTs NT11 and NT12 constitute an all gate on module (pull-up module). The TFT NT13 constitutes an all gate off (fourth pull-down module). The TFT NT14 constitutes a reset module. The TFTs NT1 and NT2 constitute the forward/backward scan control module for performing forward/backward scan function. When the forward scan control signal U2D corresponds to a high voltage level, the backward scan control signal D2U corresponds to a low voltage level and thus the scanning operation is performed sequentially from the bottom to the top. On the other hand, when the forward scan control signal U2D corresponds to a low voltage level, the backward scan control signal D2U corresponds to a high voltage level and thus the scanning operation is performed sequentially from the top to the bottom.

Specifically, the circuit comprises multiple GOA units connected in series (m stages in total). The $n^{th}$ GOA unit comprises: a forward/backward scan control module 100, a node signal control module 200, an output control module 300, a regulating module 400, a first pull-down module 500, a second pull-down module 600, a third pull-down module 700, a fourth pull-down module 800, a pull-up module 900, a reset module 110, a first capacitor C1 and a second capacitor C2. Here, $m \geq n \geq 1$.

The forward/backward scan control module 100 is used to control the GOA circuit to perform a forward scan or a backward scan according to the forward scan control signal U2D or the backward scan control signal D2U. The node signal control module is used to control the GOA unit of the current stage to output a gate driving signal having a low voltage level in the non-working phase according to the clock signal CK(N+1) of the $(N+1)^{th}$ stage and the clock signal CK(N−1) of the $(N-1)^{th}$ stage. The output control module 300 is used to control the output of the gate driving signal of the current stage according to the clock signal CK(n) of the current stage. The regulating module 400 is used to maintain the voltage level of the first node Q. The first pull-down module 500 is used to pull-down the voltage level of the first node. The second pull-down module 600 is used to pull-down the voltage level of the second node P. The third pull-down module 700 is used to pull-down the voltage level of the gate driving signal G(n) of the current stage. The fourth pull-down module 800 is used to pull-down the voltage level G(n) of the current stage according to the second global signal GAS2 when the display panel is in the second working phase. The pull-up module 900 is used to control the GOA unit of the current stage to output the gate driving signal having a high voltage level according to the first global signal GAS1 when the display panel is in the first working phase. The reset module 110 is used to reset the second node according to the reset signal. The first working phase is a working phase when the display panel is black or the power is abnormally off. It could be understood that, in the first working phase, the first global signal GAS1 corresponds to a high voltage level and all of the GOA units output the gate driving signals having a high voltage level. The second working phase is a touch control phase and the second global signal GAS corresponds to a high voltage level.

When the display panel is in the forward scan stage, the signal U2D corresponds to a high voltage level and the signal D2U corresponds to a low voltage level. At this time, the GOA circuit performs the scanning operation sequentially from the top to the bottom. In contrast, when the display panel is in the forward scan stage, the signal D2U corresponds to a high voltage level and the signal U2D corresponds to a low voltage level. At this time, the GOA circuit performs the scanning operation sequentially from the bottom to the top.

Figure 2:
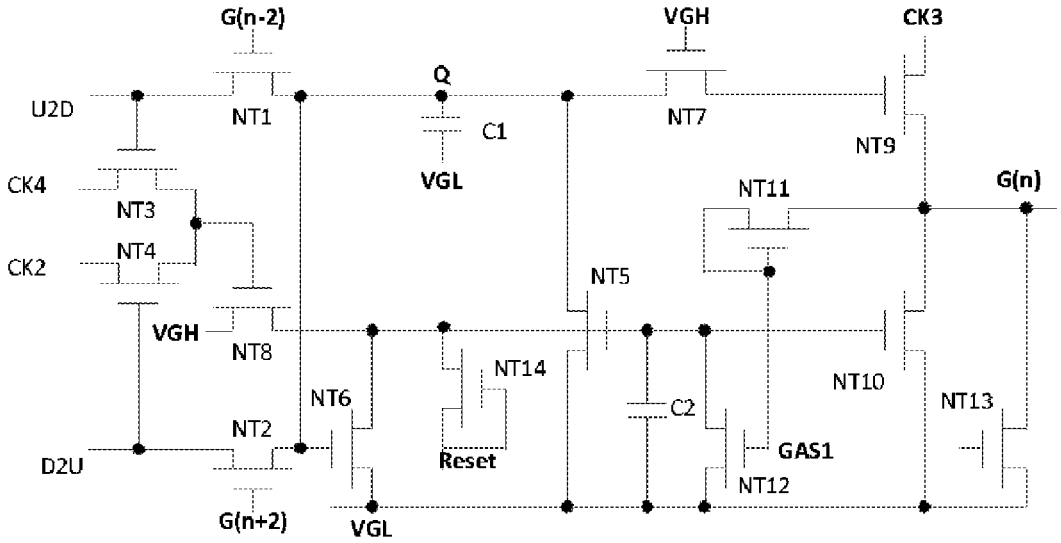
FIG. 2 is a diagram of a GOA unit of the $n^{th}$ stage in the conventional GOA circuit.
Figure 3:
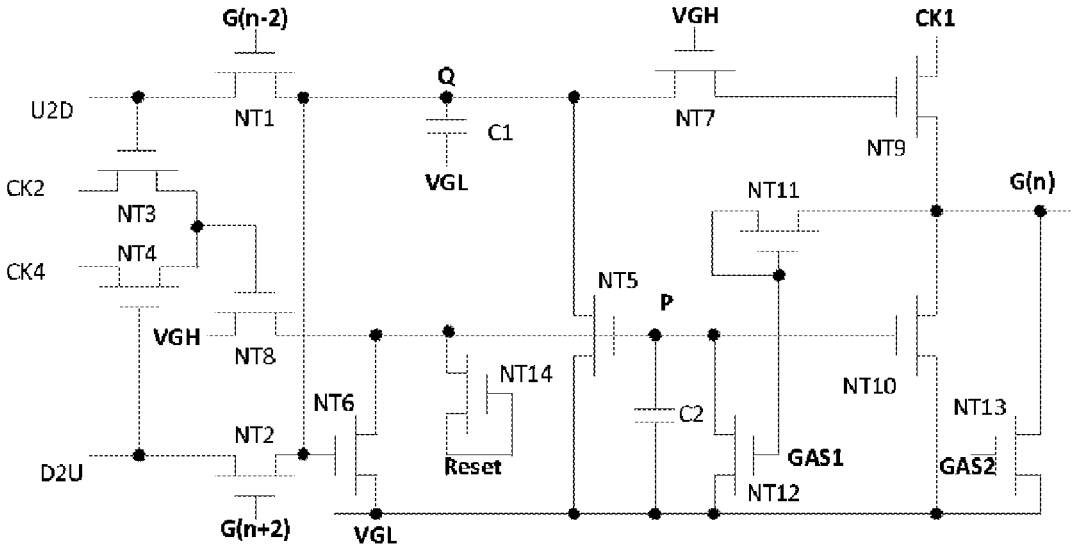
FIG. 3 is a diagram of a GOA unit of the $(n+2)^{th}$ stage in the conventional GOA circuit.

When the display panel is a 4CK structure, the GOA driving structure could adopt interface structure or double driving structure. The GOA circuit utilizes two basic units as a smallest repeating unit to form a circle. As shown in FIG. 2 and FIG. 3, the GOA unit of the $n^{th}$ stage and the GOA unit of the $(n+2)^{th}$ stage could form a GOA repeating unit. Please refer to FIG. 4, the GOA circuit has 4 clock signals, the first clock signal CK1 to the fourth clock signal CK4. When the clock signal of the $n^{th}$ stage of the GOA unit of the $n^{th}$ stage is the first clock signal CK1, the $(n+1)^{th}$ stage of the GOA unit of the $n^{th}$ stage is the second clock signal CK2 and the $(n-1)^{th}$ stage of the GOA unit of the $n^{th}$ stage is the fourth clock signal CK4. When the clock signal of the $n^{th}$ stage of the GOA unit of the $(n+2)^{th}$ stage is the third clock signal CK3, the $(n+1)^{th}$ stage of the GOA unit of the $(n+2)^{th}$ stage is the fourth clock signal CK4 and the $(n-1)^{th}$ stage of the GOA unit of the $(n+2)^{th}$ stage is the second clock signal CK2. It could be understood that if the node signal control module 200 of the GOA unit of the $n^{th}$ stage receives the second and the fourth clock signals and the output control module 300 of the GOA unit of the $n^{th}$ stage receives the first clock signal, then the node signal control module 200 of the GOA unit of the $(n+1)^{th}$ stage receives the first and the third clock signals and the output control module 300 of the GOA unit of the $(n+1)^{th}$ stage receives the second clock signal.

The duty cycle of the four clock signals CK could be 25% or lower. The display panel could also use 6CK or 8CK structure. The smallest repeating unit could be 3 or 4 basic units and the working mechanism is similar to the 4CK structure.

Figure 4:
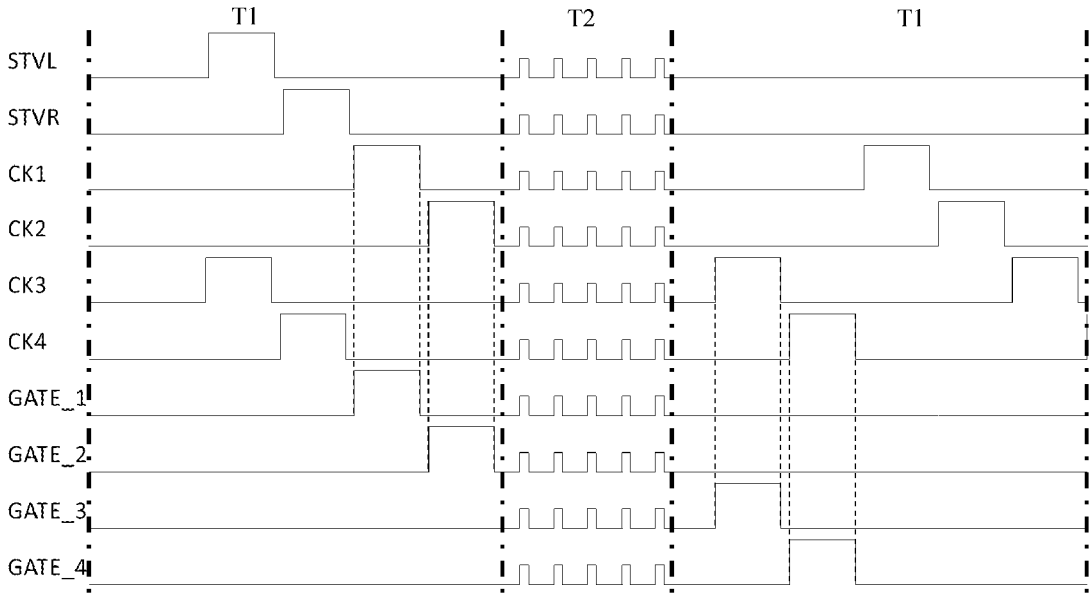
FIG. 4 is a timing diagram of the GOA circuit of a 4CK-structure display panel.

FIG. 4 is a timing diagram of the GOA circuit of a 40K-structure display panel. STVL and STVR are the starting signals. The first global signal GAS1 and the second global signal GAS2 correspond to a low voltage level when the display panel is in the working phase. The second global signal GAS2 transits from a low voltage level to a high voltage level when the display panel transits from the display phase T1 to the touch control phase T2. Furthermore, the first global signal GAS1 superposes a high voltage level signal on a low voltage level signal in the TP term (the phase T2). The second global signal GAS2 superposes a high voltage level signal on a high voltage level signal in the TP term (the phase T2).

In addition, the signals GATE_1-GATE4 respectively represent the first to the fourth scan signals, which correspond to the gate driving signals of the GOA units of the first stage to the fourth stage.

If the output control module 300 of the GOA unit of the first stage receives the first clock signal, the output control module 300 of the GOA unit of the second stage receives the second clock signal, the output control module 300 of the GOA unit of the third stage receives the third clock signal, and the output control module 300 of the GOA unit of the fourth stage receives the fourth clock signal. When the first clock signal CK1 corresponds to a high voltage level, G(1) corresponds to a high voltage level and thus the gate driving signal GATE_1 corresponds to a high voltage level as well. The other gate driving signals GATE_2-GATE_4 are similar and thus omitted here.

As shown in FIG. 1, in the TP term, the scan line stops inputting the scan signal. That is, the corresponding GOA unit stops outputting signal. At this time, the signal G(n−2) of the GOA unit and the signal U2D correspond to a high voltage level. The node Q corresponds to a high voltage level. However, although the TFT NT2 is turned off, there is still a leakage current. This reduces the stage-to-stage stability of the GOA circuit and also reduces the stability of the GOA unit.

In addition to the normal stage-to-stage transmission function, the conventional GOA circuit also has the reset module for performing a reset function, an abnormal power off (APO) mode and an all gate off mode of the TP device. However, this GOA structure needs a larger number of TFTs and a larger number of CK signal lines. Thus, the GOA circuit has a more complex structure and the GOA has a wider width. The width compression rate of the GOA is low.

Figure 5:
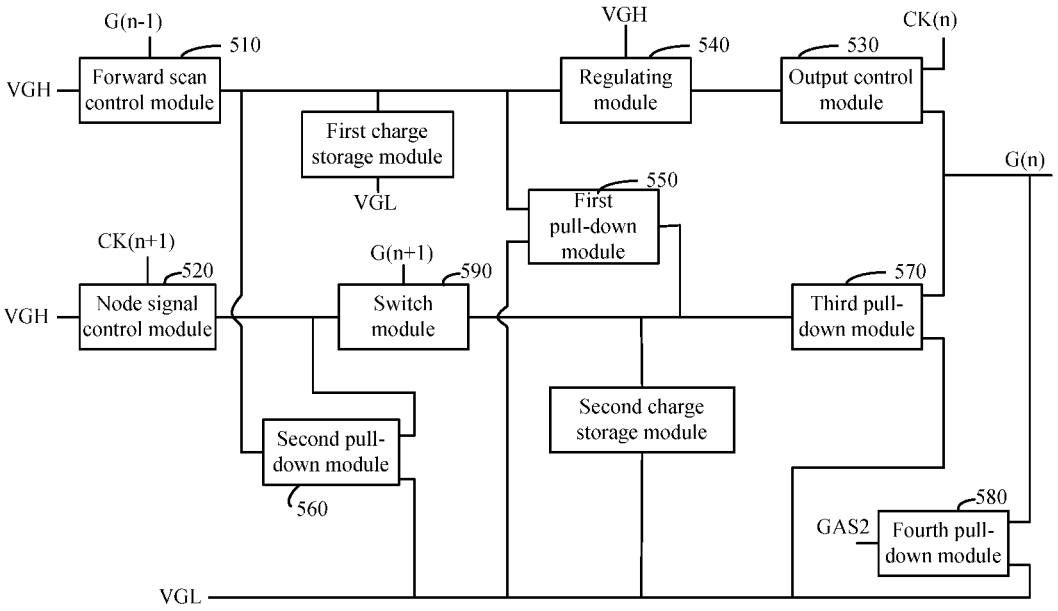
FIG. 5 is a diagram of a first structure of a GOA driving circuit of an embodiment of the present invention.

In order to solve the above-mentioned issue, in an embodiment, as shown in FIG. 5, a GOA driving circuit is disclosed. The GOA driving circuit comprises a plurality of GOA units connected in series. The GOA unit comprises: the forward scan control module 510 used to control the GOA driving circuit to perform a forward scan according to a constant voltage level signal; the node signal control module 520 used to control the GOA circuit to output a gate driving signal having a low voltage level in a non-working phase; the output control module 530 used to control the gate driving signal of the current stage according to the clock signal CK of the current stage; a regulating module 540 used to maintain the voltage level of the first node; the first pull-down module 550, used to pull-down the voltage level of the first node; the second pull-down module 560 used to pull-down the voltage level of the second node; the third pull-down module 570 used to pull-down the voltage level of the gate driving signal of the GOA unit of the current stage; the fourth pull-down module 580 used to pull-down the voltage level of the gate driving signal of the current stage according to the global signal when the GOA driving circuit is in a working phase; and the switch module 590, electrically connected between the third pull-down module and the node signal control module, used to maintain the voltage level of the second node according to the gate driving signal of the GOA unit of a next stage when the first node is being charging.

Specifically, the forward scan control module 510 is connected to the input end of the regulating module 540. The output end of the regulating module 540 is connected to the control end of the output control module 530. The node signal control module 520 is connected to the input end of the switch module 590. The output end of the switch module 590 is connected to the control end of the third pull-down module 570. The input end of the third pull-down module 570 is used to receive the low voltage level signal VGL and the output end of the third pull-down module 570 is connected to the output end of the output control module 530. The control end of the second pull-down module 560 is connected to the forward scan control module 510, the input end of the second pull-down module 560 is used to receive the low voltage level signal VGL, and the output end of the second pull-down module 560 is connected to the node signal control module 520. The control end of the first pull-down module 550 is connected to the control end of the third pull-down module 570, the input end of the first pull-down module 550 is used to receive the low voltage level signal VGL, and the output end of the first pull-down module 550 is connected to the forward scan control module 510. The control end of the fourth pull-down module 580 is used to receive the global signal GAS2, the input end of the fourth pull-down module 580 is used to receive the low voltage level signal VGL, and the output end of the fourth pull-down module 580 is connected to the output end of the output control module 530.

The forward scan control module 510 controls the GOA driving circuit to perform the forward scan according to the constant high voltage level signal VGH. The node signal control module 520 controls the GOA driving circuit to output the gate driving signal having a low voltage level when the GOA driving circuit is in the non-working phase. The regulating module 540 is used to maintain the voltage level of the first node. The first pull-down module 550 is used to pull-down the voltage level of the first node. The second pull-down module 560 is used to pull-down the voltage level of the second node. The third pull-down module 570 is used to pull-down the voltage level of the gate driving signal of the GOA unit of the current stage. The fourth pull-down module 580 is used to pull-down the voltage level of the gate driving signal of the current stage according to the global signal when the GOA driving circuit is in the working phase. The switch module 590 is used to maintain the voltage level of the second node according to the gate driving signal of the next stage when the first node is being charged. Accordingly, the output control module 540 controls the output of the gate driving signal of the current stage according to the clock signal of the current stage. In this way, the GOA unit could perform a normal stage-to-stage work.

Specifically, because the abnormal power off hardly happens to the display panel in the actual implementation and the display panel could be rebooted to be reset to normally display. Therefore, the normal operation of the GOA function is not influenced. In the above embodiment, there is no need to add any pull-up module and thus the GOA circuit could be simplified.

In the actual implementation, the scan operation could be performed in only one direction. Normally, the GOA performs the forward scan, which means the scan operation is performed from the top to the bottom of the panel. The backward scan is often used in the test mode or used to replace the forward scan when the forward scan cannot normally work. In the above embodiments, there is no need to add any backward scan control module and the GOA circuit could be further simplified to realize the narrow side frame.

In the embodiment, it does not require to add the number of the backward scan control module, the pull-up module and recovery module. In addition, it only requires two clock signals to complete the stage-by-stage driving tasks. In addition, it also simplifies the GOA driving circuit and further reduces the width of the GOA. Thus, the narrow side frame demands could be met. Here, the first clock signal is used to pull-up the voltage level of the first node. The second clock signal is used to pull-up the voltage level of the second node. Through increasing the number of the switch module, the first node and the second node could be charged in different time periods without completing with each other. Furthermore, less number of TFTs is used and only two clock signals are used, the number of signal lines are reduced and thus the width of the GOA is reduced. In this way, the narrow side frame design could be achieved. This reduces the risk in manufacturing process and raises the efficiency and stability.

In the actual implementation, the reset module is used only in the first frame. In the following display operation, each of the nodes will be automatically reset. Thus, the actual function of the reset module is comparatively limited. In the above embodiments, there is no need to add any backward scan control module and the GOA circuit could be further simplified.

In one embodiment, the GOA unit further comprises the first charge storage module. One end of the first charge storage module is connected to the first node and the other end of the first charge storage module is used to receive the low voltage level signal. The first charge storage module could be used to store the charges of the first node.

The GOA unit further comprises the second charge storage module. One end of the second charge storage module is connected between the first pull-down module and the third pull-down module and the other end of the second charge storage module is used to receive the low voltage level signal. The first charge storage module could be used to store the charges of the second node.

Figure 6:
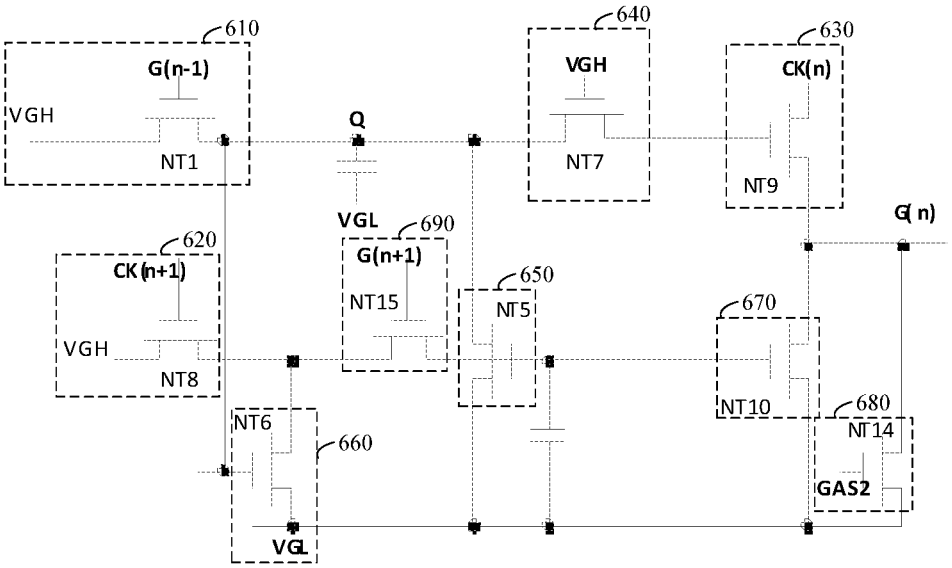
FIG. 6 is a diagram of a second structure of a GOA driving circuit of an embodiment of the present invention.

As shown in FIG. 6. A GOA driving circuit is provided. The GOA driving circuit comprises a plurality of GOA units connected in series. The GOA unit comprises the forward scan control module 610, the node signal control module 620, the output control module 630, the regulating module 640, the first pull-down module 650, the second pull-down module 660, the third pull-down module 670, the fourth pull-down module 680, and the switch module 690. The switch module 690 is electrically connected between the third pull-down module 670 and the node signal control module 620. The GOA unit further comprises the first capacitor C1. The first capacitor C1 could be used to store the charges of the first node. One end of the first capacitor C1 is connected to the first node and the other end of the first capacitor C1 is used to receive the constant low voltage level signal VGL. The first node Q is connected between the forward scan control module 610 and the regulating module 340.

Specifically, one end of the first capacitor C1 is connected to the first node and the other end of the first capacitor C1 is used to receive the constant low voltage level VGL. The first capacitor C1 could store the charges of the first node. The first capacitor C1 could be further used to provide power to the first node to assist with the output G(n) of the GOA unit.

As shown in FIG. 6, the switch module 690 comprises a $15^{th}$ TFT (thin film transistor) NT15. The $15^{th}$ TFT NT15 has the source connected to the second node, the drain connected to the third pull-down module 670, and the gate for receiving the gate driving signal of the GOA unit of the next stage. Here, the second node P is the connection point of the node signal control module 620, the switch module 690 and the second pull-down module 660.

The $15^{th}$ TFT NT15 could be a NMOS (N-Metal-Oxide-Semiconductor) TFT.

Since the $15^{th}$ TFT NT15 has the source connected to the second node, the drain connected to the third pull-down module 670, and the gate for receiving the gate driving signal G(n+1) of the GOA unit of the next stage, the gate is controlled by the gate driving signal G(n+1). In this way, the charging phases of the first node and the second node could be non-overlapped without interferences. After the signal of the current stage is transferred to the next stage, the voltage level of the second node could be pulled up.

Through adding the $15^{th}$ TFT, the $15^{th}$ TFT could be used to control the pull-up operation of the voltage level of the second node. This could prevent conflicts between the charging phases of the first node and the second node.

As shown in FIG. 6, the forward scan control module 610 comprises the first TFT NT1. The first TFT NT1 has the gate for receiving the gate driving signal G(n−1) of the GOA unit of the previous stage, the source for receiving the forward scan control signal VGH, and the drain connected to the regulating module.

The first TFT NT1 could be a NMOS TFT.

Since the gate of the first TFT NT1 receives the gate driving signal of the GOA unit of the previous stage, the source of the first TFT NT1 receives the forward DC scan control signal VGH and the drain of the first TFT NT1 is connected to the regulating module 640, it can achieve the scan from the top to the bottom of the panel. This simplifies the structure of GOA driving circuit and reduces the width of the GOA without influencing the normal function of the GOA.

As shown in FIG. 6, the node signal control module 620 comprises the $8^{th}$ TFT NT8. The gate of the $8^{th}$ TFT NT8 is used to receive the clock signal CK(n+1) of the next stage, the source of the $8^{th}$ TFT NT8 receives the constant high voltage level signal VGH, and the drain of the $8^{th}$ NT8 TFT is connected to the second node.

The $8^{th}$ TFT could be an NMOS TFT.

Because the gate of the $8^{th}$ TFT NT8 is used to receive the clock signal CK(n+1) of the next stage, the source of the $8^{th}$ TFT NT8 receives the constant high voltage level signal VGH, and the drain of the $8^{th}$ TFT NT8 is connected to the second node, the second node could be powered when the $8^{th}$ TFT is turned on.

As shown in FIG. 6, the second pull-down module 660 comprises the $6^{th}$ TFT NT6. The gate of the $6^{th}$ TFT NT6 is connected to the drain of the first TFT NT1, the source of the $6^{th}$ TFT NT6 receives the constant low voltage level signal VGL, and the drain of the $6^{th}$ TFT NT6 is connected to the second node. Therefore, the voltage level of the second node could be pulled down through the $6^{th}$ TFT NT6.

As shown in FIG. 6, the first pull-down module 650 comprises the $5^{th}$ TFT NT5. The gate of the $5^{th}$ TFT NT5 is connected to the third pull-down module 670, the drain of the $5^{th}$ TFT NT5 is connected to the first node and the source of the $5^{th}$ TFT NT5 is connected to the constant low voltage level signal VGL.

The $5^{th}$ TFT NT5 could be an NMOS TFT.

Since gate of the $5^{th}$ TFT NT5 is connected to the third pull-down module 670, the drain of the $5^{th}$ TFT NT5 is connected to the first node and the source of the $5^{th}$ TFT NT5 is connected to the constant low voltage level signal VGL, the voltage level of the first node could be pulled down through the $5^{th}$ TFT NT5.

As shown in FIG. 6, the output control module 630 comprises the $9^{th}$ TFT NT9. The gate of the $9^{th}$ TFT NT9 is connected to the regulating module 640, the source of the $9^{th}$ TFT NT9 receives the clock signal CK(n) of the current stage, and the drain of the $9^{th}$ TFT NT9 is connected to the third pull-down module 670.

The $9^{th}$ TFT NT9 could be an NMOS TFT.

Since the gate of the $9^{th}$ TFT NT9 is connected to the regulating module 640, the source of the $9^{th}$ TFT NT9 receives the clock signal CK(n) of the current stage, and the drain of the $9^{th}$ TFT NT9 is connected to the third pull-down module 670, the output control module 630 could control the output of the gate driving signal of the current stage according to the clock signal CK(n).

As shown in FIG. 6, the fourth pull-down module 680 comprises the $14^{th}$ TFT NT14. The gate of the $14^{th}$ TFT NT14 is used to receive the global signal GAS2, the source of the $14^{th}$ TFT NT14 receives the constant low voltage level signal VGL, and the drain of the $14^{th}$ TFT NT14 is connected to the drain of the output control module 630.

The $14^{th}$ TFT NT14 could be an NMOS TFT.

Since the gate of the $14^{th}$ TFT NT14 is used to receive the global signal GAS2, the source of the $14^{th}$ TFT NT14 receives the constant low voltage level signal VGL, and the drain of the $14^{th}$ TFT NT14 is connected to the drain of the output control module 630, the fourth pull-down module 680 could pull down the voltage level of the gate driving signal of the current stage according to the global signal GAS2 when the GOA driving circuit is in the working phase.

In the TP term (touch control phase), the global signal GAS2 is pulled high and thus the $14^{th}$ TFT is turned on. VGH becomes VGL. The voltage is pulled low such that the first node and the second node are turned off. In this way, the output of the $14^{th}$ TFT is not interfered.

As shown in FIG. 6, the third pull-down module 670 comprises the $10^{th}$ TFT NT10. The gate of the $10^{th}$ TFT NT10 is connected to the gate of the $5^{th}$ TFT NT5, the source of the $10^{th}$ TFT NT10 receives the constant low voltage signal VGL, and the drain of the $10^{th}$ TFT NT10 is connected to the drain of the $9^{th}$ TFT NT9. Thus, the gate driving signal G(n) of the current stage could be pulled down through the $10^{th}$ TFT NT10.

As shown in FIG. 6, the regulating module 640 comprises the $7^{th}$ TFT NT7. The gate of the $7^{th}$ TFT NT7 receives the constant high voltage signal VGH, the source of the $7^{th}$ TFT NT7 is connected to the first node Q, and the drain of the $7^{th}$ TFT NT7 is connected to the gate of the $9^{th}$ TFT NT9. Thus, the voltage level of the first node Q could be maintained through the $7^{th}$ TFT NT7.

As shown in FIG. 6, the GOA unit further comprises the second capacitor C2. The second capacitor C2 could be used to store the charges of the second node. One end of the second capacitor C2 is connected to the drain of the $15^{th}$ TFT NT15 and the other end of the second capacitor C2 is used to receive the constant low voltage signal VGL.

Because one end of the second capacitor C2 is connected to the drain of the $15^{th}$ TFT NT15 and the other end of the second capacitor C2 is used to receive the constant low voltage signal VGL, the second capacitor C2 could store the charges of the second node. In addition, the second capacitor C2 could power the second node and is beneficial to the output G(n) of the GOA unit.

Specifically, the GOA driving circuit of the present invention does not need to add backward scan control module, the pull-up module and the reset module. Instead, the GOA driving circuit only needs two clock signals CK to perform the stage-to-stage work and thus is simplified. The width of the GOA is reduced and thus the narrow side frame could be realized. Here, the first clock signal CK is used to pull-up the voltage level of the first node. The second clock signal CK is used to pull-up the voltage level of the second node. Through adding the $15^{th}$ TFT, the first node and the second node could be charged separately without affecting each other. In other words, the present invention could adopt a lower number of TFTs and only two clock signals CK. This enormously reduces the width of GOA and realizes the narrow side frame design. Furthermore, the manufacturing process risk is reduced and the stability is raised. Thus, the efficiency and the stability are raised.

In an embodiment, a display panel is disclosed. The display panel comprises the above-mentioned GOA driving circuit.

The display panel could be an LCD panel or organic light-emitting diode (OLED) display panel.

The display panel according to an embodiment only needs two clock signals CK for the GOA driving circuit to scan each row of gates. Furthermore, it could enormously reduce the width of GOA and realize the narrow side frame design. In addition, the manufacturing process risk is reduced and the stability is raised. Thus, the efficiency and the stability are raised.

The other features of the display panel could be referred to those of the GOA driving circuit and thus further illustration is omitted here.

In an embodiment, a display device is disclosed. The display device comprises the aforementioned display panel.

The display device could be, but not limited to, a cell phone, a TV or a tablet.

The display device according to an embodiment only needs two clock signals CK for the GOA driving circuit to scan each row of gates. Furthermore, it could enormously reduce the width of GOA and realize the narrow side frame design. In addition, the manufacturing process risk is reduced and the stability is raised. Thus, the efficiency and the stability are raised.

The other features of the display device could be referred to those of the display panel or the GOA driving circuit and thus further illustration is omitted here.

Above are embodiments of the present invention, which does not limit the scope of the present invention. Any modifications, equivalent replacements or improvements within the spirit and principles of the embodiment described above should be covered by the protected scope of the invention.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A gate driver on array (GOA) circuit, comprising a plurality of GOA units connected in series, the GOA unit comprising:

a forward scan control module, configured to control the GOA driving circuit to perform a forward scan according to a constant voltage level signal;

a node signal control module, configured to control the GOA circuit to output a gate driving signal having a low voltage level in a non-working phase;

an output control module, configured to control a gate driving signal of a current stage according to a clock signal of the current stage;

a regulating module, configured to maintain a voltage level of a first node;

a first pull-down module, configured to pull-down the voltage level of the first node;

a second pull-down module, configured to pull-down a voltage level of a second node;

a third pull-down module, configured to pull-down a voltage level of the gate driving signal of the GOA unit of the current stage;

a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

2. The GOA driving circuit of claim 1, wherein the GOA unit further comprises:

a first capacitor, configured to store charges of the first node, wherein the first capacitor comprises an end electrically connected to the first node and another end receiving a constant low voltage signal;

wherein the forward scan control module is electrically connected to the regulating module through the first node.

3. The GOA driving circuit of claim 1, wherein the switch module comprises:

a $15^{th}$ thin film transistor (TFT), having a source electrically connected to the second node, a drain electrically connected to the third pull-down module, and a gate receiving the gate driving signal of the GOA unit of the next stage.

4. The GOA driving circuit of claim 3, wherein the forward scan control module comprises:

a first TFT, having a gate receiving the gate driving signal of the GOA unit of a previous state, a source receiving a forward DC scan control signal, and a drain electrically connected to the regulating module; and wherein the node signal control module comprises:

an $8^{th}$ TFT, having a gate receiving the clock signal of the next stage, a source receiving the constant high voltage signal, and a drain electrically connected to the second node.

5. The GOA driving circuit of claim 4, wherein the second pull-down module comprises:

a $6^{th}$ TFT having a gate electrically connected to the drain of the first TFT, a source receiving a constant low voltage signal and a drain electrically connected to the second node.

6. The GOA driving circuit of claim 4, wherein the first pull-down module comprises:

a $5^{th}$ TFT, having a gate electrically connected to the third pull-down module, a drain electrically connected to the first node, and a source receiving a constant low voltage signal.

7. The GOA driving circuit of claim 1, wherein the output control module comprises:

a $9^{th}$ TFT, having a gate electrically connected to the regulating module, a source receiving the clock signal of the current stage, and a drain electrically connected to the third pull-down module.

8. The GOA driving circuit of claim 7, wherein the fourth pull-down module comprises:

a $14^{th}$ TFT, having a gate receiving the global signal, a source receiving the constant low voltage signal, and a drain, electrically connected to the gate of the $14^{th}$ TFT and the drain of the output control module.

9. A display panel, comprising a gate driver on array (GOA) circuit comprising a plurality of GOA units connected in series, the GOA unit comprising:

a forward scan control module, configured to control the GOA driving circuit to perform a forward scan according to a constant voltage level signal;

a node signal control module, configured to control the GOA circuit to output a gate driving signal having a low voltage level in a non-working phase;

an output control module, configured to control a gate driving signal of a current stage according to a clock signal of the current stage;

a regulating module, configured to maintain a voltage level of a first node;

a first pull-down module, configured to pull-down the voltage level of the first node;

a second pull-down module, configured to pull-down a voltage level of a second node;

a third pull-down module, configured to pull-down a voltage level of the gate driving signal of the GOA unit of the current stage;

a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

10. A display device, comprising a display panel, wherein the display panel comprises a gate driver on array (GOA) circuit comprising a plurality of GOA units connected in series, the GOA unit comprising:

a forward scan control module, configured to control the GOA driving circuit to perform a forward scan according to a constant voltage level signal;

a node signal control module, configured to control the GOA circuit to output a gate driving signal having a low voltage level in a non-working phase;

an output control module, configured to control a gate driving signal of a current stage according to a clock signal of the current stage;

a regulating module, configured to maintain a voltage level of a first node;

a first pull-down module, configured to pull-down the voltage level of the first node;

a second pull-down module, configured to pull-down a voltage level of a second node;

a third pull-down module, configured to pull-down a voltage level of the gate driving signal of the GOA unit of the current stage;

a fourth pull-down module, configured to pull-down a voltage level of the gate driving signal of a current stage according to a global signal when the GOA driving circuit is in a working phase; and a switch module, electrically connected between the third pull-down module and the node signal control module, configured to maintain the voltage level of the second node according to the gate driving signal of the GOA unit of a next stage when the first node is being charging.

* * * * *